US005660910A

United States Patent [19]

Hoyt et al.

[11] Patent Number: 5,660,910

[45] Date of Patent: Aug. 26, 1997

[54] INCREASED TEAR STRENGTH NONWOVEN FABRIC AND PROCESS FOR ITS MANUFACTURE

[75] Inventors: Matthew B. Hoyt, Arden; Katherine M. Snyder, Wilmington, both of N.C.

[73] Assignee: Akzo Nobel N.V., Arnhem, Netherlands

[21] Appl. No.: 414,411

[22] Filed: Mar. 31, 1995

[51] Int. Cl.[6] ..... B32B 3/02

[52] U.S. Cl. ..... 428/95; 428/85; 442/364; 442/382

[58] Field of Search ..... 428/297, 298, 428/299, 85, 95

[56] References Cited

U.S. PATENT DOCUMENTS

| | | | |
|---|---|---|---|
| 3,607,359 | 9/1971 | Bischoff et al. | 117/65.2 |
| 3,616,160 | 10/1971 | Wincklhofer et al. | 161/150 |
| 3,652,353 | 3/1972 | Belisle et al. | 156/62.4 |
| 3,819,462 | 6/1974 | Starr et al. | 161/62 |
| 4,091,140 | 5/1978 | Harmon | 428/288 |
| 4,107,364 | 8/1978 | Sisson | 428/196 |
| 4,211,816 | 7/1980 | Booker et al. | 428/296 |
| 4,842,915 | 6/1989 | Hartmann et al. | 428/95 |
| 4,921,659 | 5/1990 | Marshall et al. | 264/510 |
| 4,931,355 | 6/1990 | Radwanski et al. | 428/283 |
| 5,133,835 | 7/1992 | Goettmann et al. | 162/146 |
| 5,281,208 | 1/1994 | Thompson et al. | 604/378 |
| 5,296,061 | 3/1994 | Ando et'al. | 156/622 |
| 5,368,913 | 11/1994 | Ortega | 428/198 |
| 5,424,115 | 6/1995 | Stokes | 428/198 |

FOREIGN PATENT DOCUMENTS

| | | |
|---|---|---|
| 0 435 001 A2 | 12/1989 | European Pat. Off. . |
| 0 570 803 A1 | 11/1993 | European Pat. Off. . |

*Primary Examiner*—Christopher Raimund

*Attorney, Agent, or Firm*—Joseph M. Noto; Louis A. Morris

[57] ABSTRACT

A spun-bonded nonwoven composite web has randomly laid continuous matrix filaments (average linear density per filament less than 25 denier) and one or more continuous reinforcement filament (average linear density per filament which exceeds 20 denier and exceeds the average linear density per filament of said matrix filaments by at least 10 denier). The continuous matrix filaments are at least partially bonded together to form the web. The one or more continuous reinforcement filament is enmeshed in the web without substantially bonding to other filaments in the web, so as to exhibit pulled fiber behavior when the web is born.

19 Claims, 2 Drawing Sheets

INCREASED TEAR STRENGTH NONWOVEN FABRIC AND PROCESS FOR ITS MANUFACTURE

FIELD OF THE INVENTION

This invention relates generally to nonwoven fabrics and processes for making them. Specifically, the present invention relates to nonwoven fabrics exhibiting increased tear strength.

BACKGROUND OF THE INVENTION

The term "bonded" refers to the state of being physically and rather permanently fastened together such as caused when polymers are melted and fused together.

The terms "fiber" or "fibers" refer to a pliable, cohesive, threadlike object or objects having a length to width ratio exceeding 100 to 1.

The terms "filament" or "filaments" refer to fiber or fibers having extreme or indefinite length.

The terms "continuous filament" or "continuous filaments" refer to a filament or filaments that have not been intentionally cut or broken.

The terms "staple fiber" or "staple fibers" refer to fibers cut to approximately 1–6 inch lengths.

The term "spreading" refers to the behavior of a yarn that is subjected to appropriate conditions (e.g., an attenuated air flow or static charge) so that the yarn separates into individual filaments. Spreading typically occurs most readily on yarns having low twist (less than 1 twist per inch), low crimp, low entanglement and low interfiber cohesion.

The term "web" refers to a fabric-like substantially planar (two-dimensional) arrangement of filaments.

The term "spun-bonded" refers to nonwoven fabrics formed by filaments that have been extruded, dram, then laid on a continuous belt to form a web. Bonding can be accomplished by several methods such as by hot roll calendering of the web or by passing the web through a saturated-steam chamber at an elevated pressure.

The term "monofilament" is any single filament of a manufactured fiber, usually of a denier higher than 20. Instead of a group of filaments being extruded through a spinneret to form a yarn, monofilaments generally (but not essentially) are spun individually. Monofilaments can be used for textiles such as hosiery or sewing thread or for nontextile uses such as bristles, papermaker's felts, fishing lines, etc.

The term "thermoplastic" is used to describe a plastic material that is permanently fusible.

The term "pulled reinforcement fibers" refers to fibers that extend more than 1 cm. from the fabric into the tear after a fabric is torn using ASTM D 2261-83. When more than three fibers of the reinforcement have been pulled out from the fabric such a condition indicates that the reinforcement yarn is not tightly bonded in the fabric and is able to spread the force at the propagation point of the tear over a larger area of the fabric than possible if the reinforcement is tightly bound. The term "pulled reinforcement fibers" does not apply in the case of delamination, which is the separation of layers of fabric parallel to the fabric surface.

Nonwoven web materials are known and find utility in a great variety of products including filters, scouring materials, abrasive carriers and carpet backing, as well as many other applications. Nonwoven webs made from continuous filaments have been described. For example, U.S.

Pat. No. 3,616,160 to Wincklhofer et al. describes nonwoven webs formed from multiconstituent filaments. "Multiconstituent filaments" are defined as made by the inclusion of at least one polymeric material in a matrix of another by discontinuous fibrils. The materials have substantially different melting points. Such a structure is described as creating tongue tear strength up to 14.8 lbs. The multiconstituent filaments may be laid down with other types of filaments.

For many applications of nonwoven fabrics, including use as a carpet backing, a lingering obstacle has been how to provide sufficiently high tear strength. Many methods for improving the tear strength of nonwovens have been proposed. U.S. Pat. No. 3,607,359 to Bischoff et al. describes impregnating a nonwoven fabric with a low temperature latex bonding agent. This method is taught as increasing tear strength 35 to 50 percent higher than tear strength of nonwoven fabrics made prior to the patent. Specific tear strength values are not specified.

U.S. Pat. No. 3,652,353 to Belisle et al. discloses a multilayered laminate and describes a process for gluing staple fibers to a nonwoven web to impart improved tear strength. The stated rationale for the improved tear strength is the angular disposition of the fibers in the respective layers. That is, when the fibers are disposed substantially perpendicular to each other, the tear strength characteristics increase because tearing the laminate in any direction requires the breaking of fibers rather than merely spreading them apart. No strength values are reported.

U.S. Pat. No, 3,819,462 to Starr et al. discloses a nonwoven made from a base web formed from short length fibers (staple fibers) having continuous filaments stitched on the web in a tricot pattern. This web is described as useful for a tufted carpet primary backing. Two different deniers of staple fibers are used. The coarsest fibers are in the range of 6 to 20 denier per filament. The fine fibers have deniers of up to about 3 denier per filament. A 70 denier continuous multifilament polyester thread was used for the tricot pattern stitching. No strength values are reported.

U.S. Pat. No. 4,107,364 to Sisson discloses a drapeable nonwoven fabric. This fabric is made from at least one, and preferably at least two, separate streams of monofilaments of one or more fiber-forming synthetic organic polymers which are melt spun through one or more linear dyes or spinnerets from one or more extruders and laid down to form a nonwoven web. Prior to lay down, all the filaments are mechanically drawn to a textile denier (1 to 15 denier per filament).

U.S. Pat. No. 4,211,816 to Booker et al. describes the use of 10 to 20 denier per filament continuous heterofilaments to make a nonwoven web. These heterofilaments are made of at least two fiber-forming synthetic polymer components arranged in a sheath/core manner with the core being isotactic polypropylene and the sheath being high density polyethylene. Homofilaments may also be present in these fabrics in an amount of up to 30 weight percent. The filaments preferably have deniers in the range of 10 to 20. Elmendorf tear strength of at least 6 lb and normalized grab tensile strength of at least 120 are reported.

U.S. Pat. No. 4,921,659 to Marshall et al. describes a web formed by feeding separate supplies of long and short staple fibers. No strength data is provided.

U.S. Pat. No. 5,133,835 to Goettmann et al. describes a nonwoven composite web made of a blend of two or three different types of staple fibers having different lengths and different deniers. The maximum denier reported is 15. This web is described as providing a high tensile strength paper-like web.

There remains a need for high tear strength nonwoven materials for particular applications as tufting substrates, especially carpet tufting substrates. For example, for certain automotive carpets, the tufting substrate must consistently have tongue tear of at least 15 lbs as measured by ASTM D 2261-83 applied to nonwovens.

SUMMARY OF THE INVENTION

The present invention satisfies the need for spun-bonded nonwoven composite web having randomly laid continuous matrix filaments of an average linear density per filament less than 25 denier and one or more continuous reinforcement filament of an average linear density per filament which exceeds 20 denier and exceeds the average linear density per filament of the matrix filaments by at least 10 denier. The continuous matrix filaments are at least partially bonded together to form the web and the one or more continuous filament is enmeshed in the web without substantially bonding to other filaments in the web.

In another embodiment of the present invention, a spun-bonded nonwoven composite web includes randomly laid continuous mat fix filaments of an average denier per filament less than 25. These continuous matrix filaments are at least partially bonded together to form the web. One or more continuous reinforcement filament having an average linear density per filament which exceeds 20 denier and exceeds the linear density of the matrix filaments by at least 10 denier is included in the web. The one or more continuous reinforcement filaments are substantially not bonded to each other or to the continuous matrix filaments, so that the web exhibits pulled reinforcement fiber behavior.

It is an object of the present invention to provide a nonwoven spun-bonded web having high tear strength.

Another object of the present invention is to provide a process for making a nonwoven spun-bonded web having high tear strength.

Related objects and advantages will be apparent to those of ordinary skill in the art after reading the following detailed description.

DESCRIPTION OF THE PREFERRED EMBODIMENTS

Figure 1:
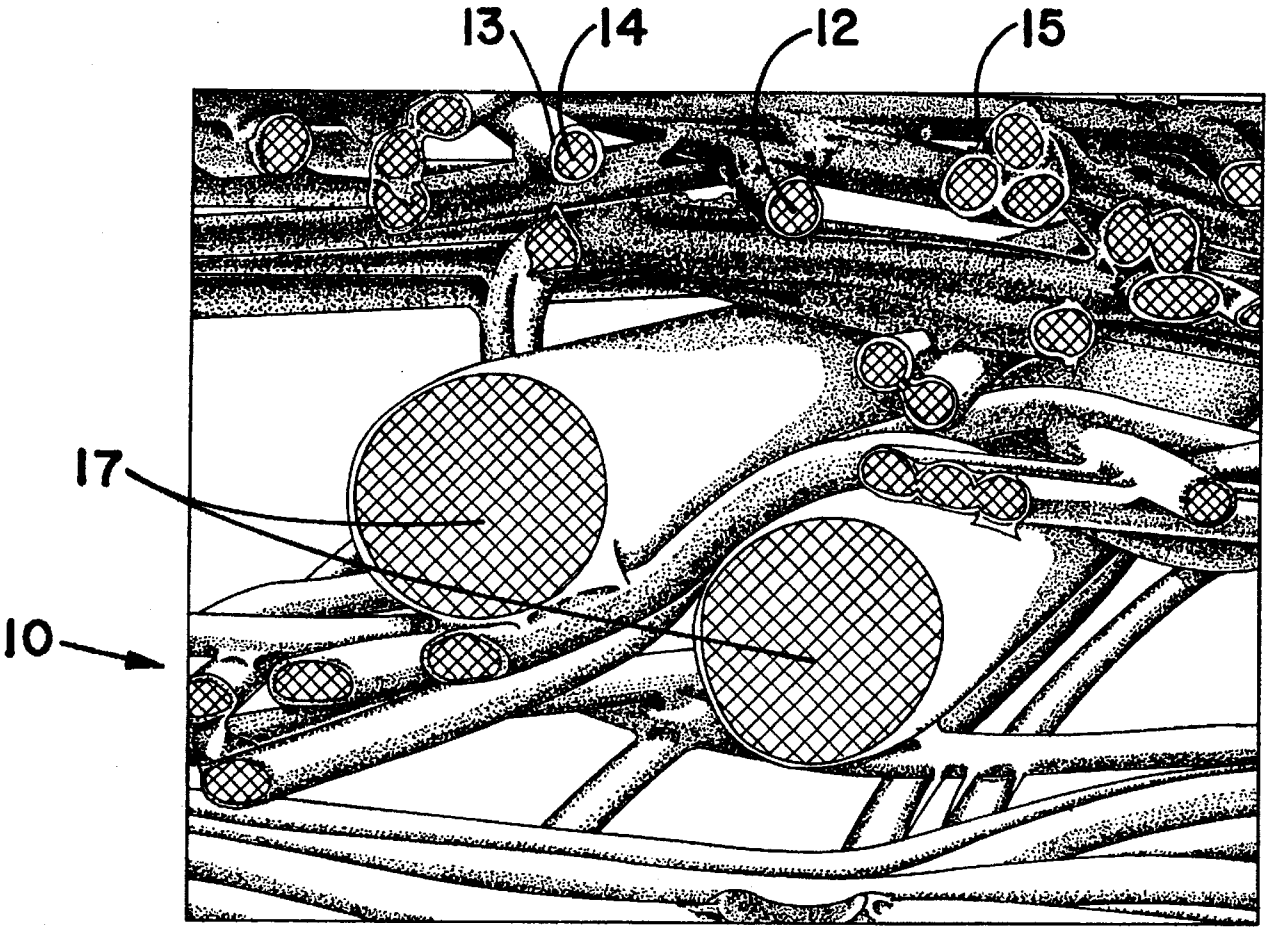
FIG. 1 shows a greatly enlarged cross-sectional view of a nonwoven fabric made according to the present invention.

To promote an understanding of the principles of the present invention, descriptions of specific embodiments of the invention follow, and specific language describes the same. It will nevertheless be understood that no limitation of the scope of the invention is thereby intended, and that such alterations and further modifications, and such further applications of the principles of the invention as discussed are contemplated as would normally occur to one ordinarily skilled in the art to which the invention pertains.

A first embodiment of the present invention includes a spun bonded nonwoven composite web. This web is composed of two different types of continuous filaments. One type of the continuous filaments are matrix filaments having a linear density (denier) per filament less than 25 denier. The other type of continuous filaments are reinforcement filaments having an average linear density (i.e., denier) per filament which exceeds 20 denier and exceeds the average linear density per filament of the matrix filaments by at least 10 denier. The matrix filaments form the basic nonwoven web structure and are the primary component of the web. The matrix filaments are at least partially bonded together to form the web while the reinforcement of filaments are enmeshed in the web without substantially bonding to other filaments in the web.

Preferably, the matrix filaments are from about 80 to about 99 weight percent of the web. More preferably, the matrix filaments are present at about 90 to 98 weight percent of the web and, most preferably, 92 to 96 weight percent of the web. The matrix filaments have an average denier per filament of less than 25. The matrix filaments are preferably thermoplastic filaments. There are numerous thermoplastic materials which are suitable for use in the present invention. For example, these thermoplastics include polyesters (for example, polyethylene terephthalate), polyamides (for example, nylon 6 and nylon 6,6), polyolefins, copolymers of these, blends of these polymers (for example, a homogeneous blend) and non-blended domains of these (for example, side-by-side filaments). The matrix filaments may also be in the form of mixed yarns where two more different types of filaments are combined. For example, several of the filaments might be homofilaments and several might be multicomponent filaments or kinds of homofilaments. All of these filaments may be made according to conventional extrusion processes. These processes are known to those ordinarily skilled in the art.

When the matrix filaments are composed of non-blended domains of thermoplastic polymers, these domains may be arranged in a variety of manners relative to each other including sheath/core arrangements, side-by-side arrangements, islands-in-the sea arrangements, and etc. In selecting the components, it may be advantageous to select one that is lower melting than the other. Then, the lower melting component can be melted during the web formation process. The molten component will flow at least to some extent and fuse at points of intersection with other filaments. These points of fusion will be bonds after cooling and resolidification. The use of a lower melting component obviates the use of an adhesive. Preferably, the matrix filaments are sheath/core bicomponent filaments with lower melting polycaprolactam forming the sheath around a polyethylene terephthalate core.

As noted, the matrix filaments can also be a mixed yarn where different types of filaments are combined. For example, polyamide monocomponent filaments and polyester monocomponent filaments can be combined to form the matrix filaments. Alternatively, the matrix filaments can be composed of both monocomponent and bicomponent filaments.

There is presently not believed to be any limitation on the cross-section of the matrix filaments. These filaments may, therefore, be any conventional cross-sections such as round, triangular, trilobal, etc. As noted, the average denier of the matrix filaments is less than 25. More preferably, the average denier per filament of the first type of filaments will not exceed 20.

The second type of continuous filaments are reinforcement filaments. These filaments have an average denier per filament which exceeds 20 and also exceeds the denier per filament of the first type of filaments by at least 10.

The reinforcement filaments are also preferably thermoplastic. A variety of thermoplastic materials are suitable for making the reinforcement filaments. These thermoplastics include polyesters (for example, polyethylene terephthalate), polyamides (for example, nylon 6 and nylon 6,6), polyolefins, copolymers of these, blends of these polymers and non-blended domains of these polymers, such as, side-by-side cross-sections. Most preferably, the reinforcement filaments are polyethylene terephthalate or nylon 6,6 filaments. Nylon 6,6 filaments are presently most preferred. As will be apparent to those ordinarily skilled in the art, the reinforcement filaments can be made by any known means for making filaments of the type.

Although the reinforcement filaments may have a variety of cross-sectional configurations, they are preferably monofilaments having the denier limitations described. As noted, the average linear density per filament of the reinforcement filament will exceed 20 denier but will, in any case, exceed the average linear density per filament of the matrix filaments by at least 10 denier. Most preferably, the linear density of the reinforcement filaments will exceed 50 denier per filament and will exceed the linear density per filament of the matrix filaments by at least 35 denier.

In many applications the nonwoven web will be dyed. This is especially true when the web is used as a tufting substrate for carpets because the tufting substrate is dyed along with the face fiber. It is advantageous, therefore, that the matrix materials and the reinforcement exhibit similar dyeability to each other. For example, when the matrix is a nylon 6/polyester sheath/core filament which dyes with acid dyes, the reinforcement should also dye with acid dyes to a similar degree.

The web of the invention may be made by several conventional techniques described below. Also, many techniques for bonding the web are envisioned. These techniques include use of adhesives, e.g., latex adhesive and thermally activated adhesives. Melt bonding is currently the preferred method for bonding. This process includes spreading the matrix filaments on a bonding delivery mechanism to form a web having exposed surfaces. One or more reinforcement filaments are also fed to the bonding delivery mechanism and then the web is bonded. The matrix filaments and the reinforcement filaments may be fed simultaneously to the bonding delivery mechanism. It is preferable, however, if first a layer of matrix filaments is spread prior to the feeding of the reinforcement filaments which is then followed by the deposition of a second set of the matrix filaments such that a sandwich-type structure is formed.

FIG. 1 is a greatly magnified cross-sectional view of randomly laid nonwoven web 10 of the present invention. Matrix filaments 12 have a sheath/core structure. Sheath 13 surrounds core 14. Matrix filaments 12 are bonded at points of intersection 15. Reinforcement filaments 17 are interspersed among matrix filaments 12 and are much larger. In the specific embodiment shown in FIG. 1, the sheath material has been melted or softened to incorporate the core material at points of intersection 15.

Figure 2:
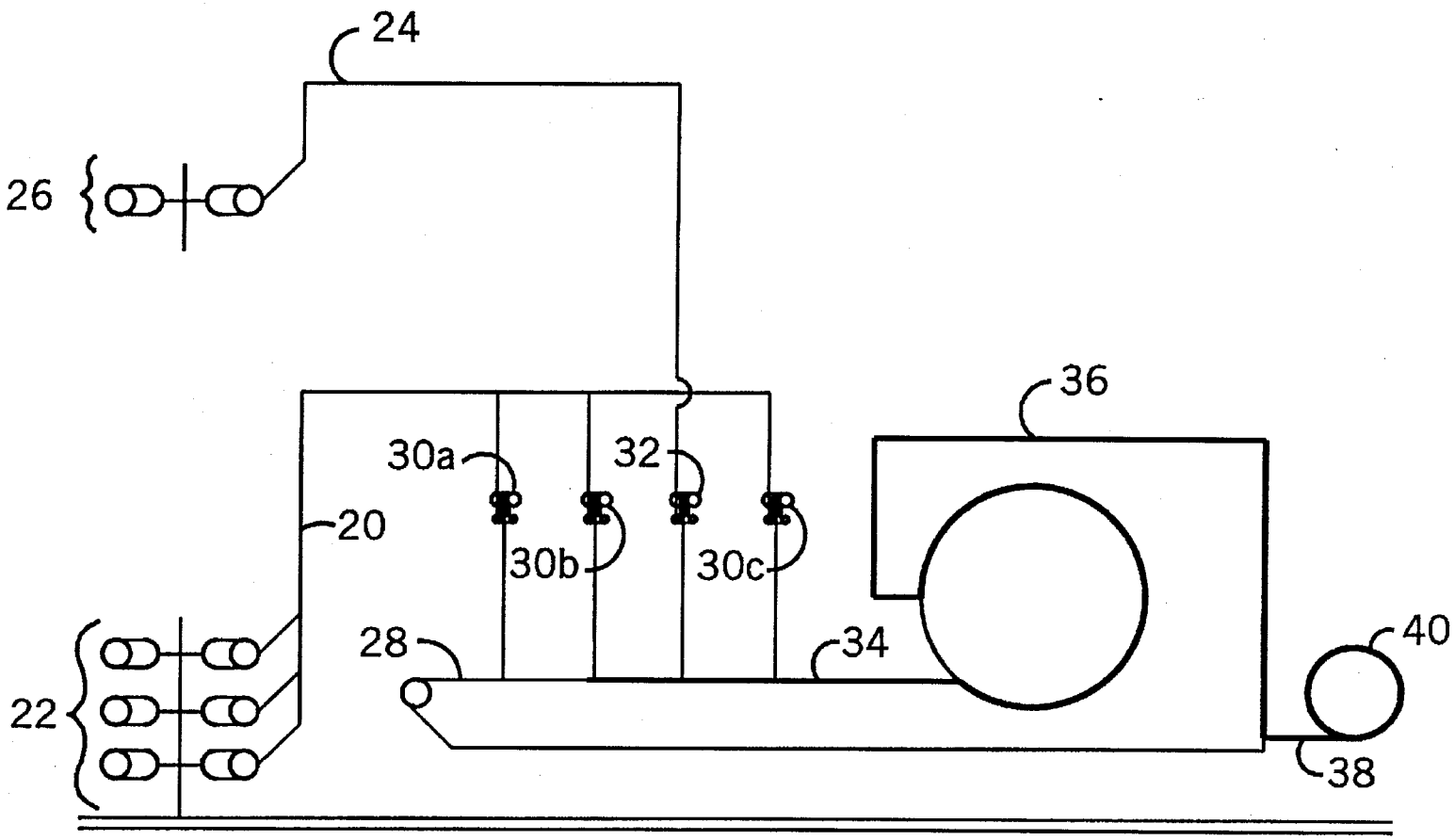
FIG. 2 illustrates schematically a process for making the nonwoven fabric of the present invention.

In general, the web of the present invention may be made according to several known methods for making nonwoven webs. One method involves extruding filaments directly onto a moving belt. Such a method is shown in U.S. Pat. No. 5,368,913 to Ortega which is incorporated herein by reference. In other methods for making a web according to the present invention, filaments which are already spun and wound up are laid down on a moving belt. FIG. 2 illustrates such a method schematically.

Matrix filaments 20 are supplied from set of six creels 22. Reinforcement filaments 24 are supplied from set of two creels 26. More or less creels may be present in each set depending on the weight of the web being made. Each type of filaments is supplied to an air aspirator for random laying down on moving belt 28. Each air aspirator shown in FIG. 2 represents a row of aspirators but only the first aspirator in each row is shown. The number of aspirators in a row depends on the desired width of the nonwoven fabric to be made. Matrix filaments 20 are supplied to row of aspirators 30*a*, 30*b* and 30*c*. Aspirators 30 deposit matrix filaments randomly on moving belt 28.

Reinforcement filaments 24 are supplied to air aspirator 32 which deposits them randomly on moving belt 28 in between matrix filaments 20.

Following air aspiration and deposition on moving belt 28, an unbonded web of filaments 34 is advanced to bonding device 36 by the motion of moving belt 28. Bonding device 36 may be an oven, a drum with heated walls or any other bonding device, with or without means for applying pressure to the web during bonding. It is not necessary that bonding device 36 uses heat. Other bonding methods, such as adhesive application, are contemplated. Thermal bonding is presently preferred where the nature of the matrix filaments makes it feasible. Following bonding, bonded web 38 is taken up onto roll 40.

When the matrix filaments include bicomponent filaments having a lower melting component, heat and pressure are preferably used in the bonding step. This involves heating one or more layers under pressure in such a way that the thermoplastic binder (i.e, the lower reciting component ) melts and flows to incorporate the higher melting component. For example, in the case of endless bicomponent filaments with a lower melting component in the sheath, the melted sheaths run together and form a network of bonding points at the intersection of the filaments. The bonding can, of course, include other bonding mechanisms. For example, binders may be used.

This invention will be described by reference to the following detailed examples. The examples are set forth by way of illustration, and are not intended to limit the scope of the invention.

TEST METHODS

In the following examples, the following methods are used:

Elmendorf Tear Strength: ASTM D 1424-83

Tongue Tear: ASTM D 2261-83

Breaking Load and Elongation: ASTM D 4830-88

EXAMPLE 1 (Invention)

On a thermal bonding machine, a web is formed from 4 layers of filaments. These layers are created by blowing yarn through 4 rows of nozzles onto a moving belt. In the first, third and fourth rows 13.5 denier per filament yarn ("matrix yarn") is deposited. The matrix yarn is a sheath/core bicomponent yarn where the polymer in the sheath is nylon 6 and the polymer in the core is polyethylene terephthalate. In the second row, a single 300 denier nylon 6,6 monofilament ("reinforcement yarn") is laid onto the moving belt.

These layers of filaments are thermally consolidated by passing the belt to a source of heated air. The temperature of the heated air is adjusted such that the polymer in the sheath of each matrix filament will soften or melt and create bonds where it is in contact with another sheath. The deposition speed of the filaments and the speed of the moving belt are adjusted to produce a fabric that weighs 120 grams per square meter. The deposition speed of the filaments is greater than the speed of the belt.

All the godets feeding the yarn to the deposition nozzles are operated at the same speed. The theoretical weight ratio of reinforcement filaments to matrix filaments was:

300 denier/(3*1485 denier)*100=6.7% of weight of fabric

The strength and elongation of the fabric is determined to be 399N/5 cm and 50.6% in the machine direction and 355.83N/5 cm and 49.9% in the cross machine direction. The fabric delaminated prior to tear in the Elmendorf Tear Test.

The average tongue tear strength of this fabric is 24.9 and 25.3 lbs in the machine and cross machine directions respectively. Approximately half of the samples delaminated in the tongue tear test, those that do not delaminate exhibit the pulled reinforcement fiber phenomenon.

EXAMPLE 2 (Comparative)

A fabric is created exactly as in Example 1 with the exception that no monofilament yarn is inserted. This fabric has strength and elongation of 375N/5 cm and 49% in the machine direction and 360N/5 cm and 50% in the cross machine direction.

Elmendorf tear strengths is 111.6 grams in the machine direction and 111.4 grams in the cross machine direction. The average tongue tear strengths are found to be 22.0 lbs in the machine direction and 21.2 lbs in the cross machine direction.

EXAMPLE 3 (Invention)

The nonwoven fabric made in Example 1 has a nylon carpet yarn tufted into it using an 8 gauge carpet tufting machine. The tufted carpet is then dyed. The dyed, tufted carpet is coated on the side away from the face with polyethylene. After coating, the carpet is heated to soften the coating and placed in a mold that impresses a shape corresponding to the floor of an automobile.

The average tongue tear strengths of the molded fabrics is 17.2 and 20.0 lbs in the machine and cross machine directions, respectively. This fabric exhibits pulled reinforcement fiber phenomenon.

EXAMPLE 4 (Comparative)

The nonwoven fabric made in Example 2 has a nylon carpet yarn tufted into it using an 8 gauge carpet tufting machine. The tufted fabric is then dyed. The dyed, tufted carpet is coated on the side away from the face with polyethylene. After coating, the carpet is heated to soften the coating and placed in a mold that impresses a shape corresponding to the floor of an automobile.

The average tongue tear strengths of the molded fabrics are found to be 9.7 and 18.6 lbs in the machine and cross machine directions, respectively.

EXAMPLE 5(Invention)

A fabric is created exactly as in Example 1 with the exception that 300 denier polyethylene terephthalate monofilament ("reinforcement yarn") is used as the reinforcement yarn instead of nylon 6,6 monofilament. The average tongue tear strength of this fabric is 30.3 and 31.8 lbs. in the machine and cross machine directions respectively. Approximately half of the samples delaminated in the tongue tear test, those that did not delaminate exhibited pulled reinforcement fibers.

EXAMPLE 6 (Invention)

The nonwoven fabric of Example 5 has a nylon carpet yarn tufted into it using an 8 gauge carpet rafting machine. The tufted fabric is then dyed. The dyed tufted carpet is then coated with polyethylene on the side away from the face.

The average tongue tear strengths of the coated fabrics is 25.9 and 33.2 lbs in the machine and cross machine directions, respectively. This fabric exhibits pulled reinforcement fibers behavior.

TABLE

| Example | Elmendorf Tear (grams) MD | Elmendorf Tear (grams) XMD | Tongue Tear (lbs) MD | Tongue Tear (lbs) XMD | Pulled Reinforcement Behavior |
|---|---|---|---|---|---|
| 1 | * | * | 24.9 | 25.3 | Yes |
| 2 | 111.6 | 111.4 | 22.0 | 21.2 | No |
| 3 | N/A | N/A | 17.2 | 20.0 | Yes |
| 4 | N/A | N/A | 9.7 | 18.6 | No |
| 5 | N/A | N/A | 30.3 | 31.8 | Yes |
| 6 | N/A | N/A | 25.9 | 33.2 | Yes |

*delaminated

What is claimed is:

1. A spun-bonded nonwoven composite web comprising:

randomly laid continuous matrix filaments having an average linear density per filament less than 25 denier; and continuous reinforcement filaments having an average linear density per filament which exceeds, 20 denier and exceeds the average linear density per filament of said matrix filaments by at least 10 denier;

wherein said continuous matrix filaments are at least partially bonded together to form said web and said continuous filament are enmeshed in said web without substantially bonding to other filaments in said web such that when the web is torn in accordance with ASTM D 2261-83, more than three reinforcement filaments are pulled out more than 1 cm from the web into the tear.

2. The web of claim 1 wherein said continuous matrix filaments are thermoplastic filaments.

3. The web of claim 2 wherein said thermoplastic is selected from the group consisting of:

polyesters;

polyamides;

polyolefins;

blends of these; and non-blended domains of these.

4. The web of claim 3 wherein said first continuous matrix filaments are sheath/core bicomponent filaments with polycaprolactam forming a sheath around a polyethylene terephthalate core.

5. The web of claim 1 wherein said continuous reinforcement filaments are thermoplastic filaments, said thermoplastic selected from the group consisting of:

polyesters;

polyamides;

polyolefins;

blends of these; and non-blended domains of these.

6. The web of claim 5 wherein said continuous reinforcement filaments are polyethylene terephthalate filaments.

7. The web of claim 6 wherein said continuous reinforcement filaments are nylon 6,6 filaments.

8. The web of claim 1 wherein said continuous matrix filaments have an average linear density per filament not exceeding 20 denier.

9. The web of claim 1 wherein said continuous reinforcement filament have an average linear density per filament exceeding 50 denier.

10. The web of claim 8 wherein said continuous reinforcement filament have an average denier per filament exceeding 50.

11. The web of claim 1 wherein said continuous matrix filaments are sheath/core bicomponent filaments having a polycaprolactam sheath surrounding a polyethylene terephthalate core with an average denier per filament not exceeding 20 and said continuous reinforcement filaments are polyethylene terephthalate filaments having an average denier per filament of at least 50 and exceeding the denier per filament of said continuous matrix filaments by at least 35.

12. The web of claim 1 wherein said continuous matrix filaments are sheath/core bicomponent filaments having a polycaprolactam sheath surrounding a nylon 6,6 core with an average denier per filament not exceeding 20 and said continuous reinforcement filaments are nylon 6,6 filaments having an average denier per filament of at least 50 and exceeding the denier per filament of said continuous matrix filaments by at least 35.

13. A carpet created by tufting a yarn into the web of claim 1.

14. A carpet created by tufting a yarn into the web of claim 4.

15. A carpet created by tufting a yarn into the web of claim 11.

16. A carpet created by tufting a yarn into the web of claim 12.

17. The web of claim 1 wherein said web has at least three layers, said continuous matrix filaments forming the outermost layers and said reinforcement filaments sandwiched by said outermost layers.

18. A spun-bonded nonwoven composite web comprising:

randomly laid continuous matrix filaments having an average denier per filament less than 25, said continuous matrix filaments at least partially bonded together to form a web; and continuous reinforcement filaments having an average linear density per filament which exceeds 20 denier and exceeds the linear density of said matrix filaments by at least 10 denier, said continuous reinforcement filaments substantially not bonded to each other or to said continuous matrix filaments, such that when the web is torn in accordance with ASTM D 2261-83, more than three reinforcement filaments are pulled out more than 1 cm from the web into the tear.

19. A carpet created by tufting a yarn into the web of claim 18.

* * * * *